US008381814B2

(12) United States Patent
Lockhart

(10) Patent No.: US 8,381,814 B2
(45) Date of Patent: Feb. 26, 2013

(54) GROUNDWATER ISOLATION BARRIERS FOR MINING AND OTHER SUBSURFACE OPERATIONS

(75) Inventor: Michael D. Lockhart, Charlottesville, VA (US)

(73) Assignee: General Synfuels International, Inc., Delta, CO (US)

( * ) Notice: Subject to any disclaimer, the term of this patent is extended or adjusted under 35 U.S.C. 154(b) by 348 days.

(21) Appl. No.: 12/704,852

(22) Filed: Feb. 12, 2010

(65) Prior Publication Data

US 2011/0198084 A1 Aug. 18, 2011

(51) Int. Cl.
*E21B 33/13* (2006.01)

(52) U.S. Cl. ..... 166/292; 166/268; 166/305.1

(58) Field of Classification Search ..... 166/268, 166/272.1, 288, 292, 305.1
See application file for complete search history.

(56) References Cited

U.S. PATENT DOCUMENTS

| | | | | |
|---|---|---|---|---|
| 3,227,212 | A | 1/1966 | Black et al. | |
| 3,400,761 | A * | 9/1968 | Latimer, Jr. et al. | 166/270 |
| 4,844,168 | A * | 7/1989 | Sydansk | 166/270 |
| 5,146,985 | A | 9/1992 | Alquie et al. | |
| 6,145,592 | A | 11/2000 | Jones et al. | |
| 6,843,841 | B2 | 1/2005 | Reddy et al. | |
| 7,281,579 | B2 | 10/2007 | Thomas et al. | |
| 7,304,098 | B2 | 12/2007 | Li et al. | |
| 8,016,039 | B2 * | 9/2011 | Hodgins et al. | 166/279 |
| 2003/0079877 | A1 * | 5/2003 | Wellington et al. | 166/272.1 |
| 2004/0069720 | A1 * | 4/2004 | Clausen et al. | 210/749 |
| 2008/0135243 | A1 * | 6/2008 | Hodgins et al. | 166/270 |

* cited by examiner

*Primary Examiner* — Kenneth L Thompson
*Assistant Examiner* — Catherine Loikith
(74) *Attorney, Agent, or Firm* — Gifford, Krass, Sprinkle, Anderson & Citkowski, P.C.

(57) ABSTRACT

To protect an underground aquifer from pollution due to the extraction of subsurface products from a recovery well or other subsurface mining operation, a plurality of barrier injection wells are formed around the recovery well/subsurface operation, each barrier injection well terminating in a groundwater layer to be protected. A polymer matrix material is then into the injection wells such that the material exiting each injection well expands and overlaps with material exiting from adjacent wells prior to solidification, thereby forming an isolation barrier within the groundwater layer. In the preferred embodiment, the polymer matrix material is a cellulose polymer hydrogel matrix material which is injected in gel form. Following recovery of the hydrocarbonaceous products from the recovery well(s), the injected polymer matrix material may be reheated and subsequently liquefied allowing full groundwater flow to occur.

16 Claims, 4 Drawing Sheets

Straight Chain Polyacrylamide

Tropocollagen triple helix.

Three-dimensional structure of cellulose.

GROUNDWATER ISOLATION BARRIERS FOR MINING AND OTHER SUBSURFACE OPERATIONS

FIELD OF THE INVENTION

This invention relates generally to the recovery of hydrocarbonaceous products from nonrubilized oil shale and oil/tar sands and other mining/subsurface operations and, in particular, to a system and method for protecting groundwater during such operations.

BACKGROUND OF THE INVENTION

Commonly assigned U.S. patent application Ser. No. 12/421,325 describes apparatus and methods for recovering hydrocarbonaceous and additional products from nonrubilized oil shale and oil/tar sands. The method comprises the steps of forming a hole in a body of nonrubilized oil shale or sand, positioning a gas inlet conduit into the hole, and introducing a heated, pressurized processing gas into the hole through the inlet, thereby creating a nonburning thermal energy front sufficient to convert kerogen in oil shale or bitumen in oil sand to hydrocarbonaceous products. The processing gas and hydrocarbonaceous products are withdrawn as effluent gas through the hole, and a series of condensation steps are performed on the effluent gas to recover various products.

In the preferred embodiment, a negative pressure relative to the well inlet pressure is maintained to ensure positive flow of the combustion and product gases, this is performed by a method of blowers on the front and or back side of the well and the removal of mass during the condensation steps. Also in the preferred embodiment, one or more initial condensation steps are performed to recover crude-oil products from the effluent gas, followed by one or more subsequent condensation steps to recover additional, non-crude-oil products from the effluent gas. In conjunction with oil/tar sands, the method includes the step of providing an apertured sleeve within the hole to limit excessive in-fill.

In accordance with the above-referenced application, a basic system for recovering hydrocarbonaceous and other products from a hole drilled in nonrubilized oil shale and oil/tar sands comprises a combustor for heating and pressurizing a processing gas, a gas inlet conduit for introducing the processing gas into the hole to convert kerogen in oil shale or bitumen in oil sand into hydrocarbonaceous products, and a gas outlet conduit for withdrawing the processing gas and hydrocarbonaceous products from the hole. Through the use of multiple condensation steps to recover non-crude products, negative down-well pressure to fine-tune extraction parameters, and carbon sequestration techniques, the disclosed apparatus and methods are significantly more 'environmentally friendly' when compared to previous approaches.

Nevertheless, environmental issues remain. In particular, groundwater vulnerability, hazards, and protection will always be major concerns relating to current surface retorting or other in situ recovery oil shale operations. Much of Colorado, Wyoming and Utah—where large oil shale and sands deposits are present—have very limited water resources. Groundwater is the major source for drinking, irrigation and other uses. Present water consumption exceeds natural replenishment. Recently water pollution problems have placed an additional strain on scarce water resources.

Other in situ processes offer a very attractive proposition because of they reduce standard surface environmental problems, but some of these processes involve potentially significant environmental costs to aquifers. These methods can cause groundwater contamination because the hydraulic conductivity of the remaining spent shale increases and allows groundwater to flow through and leach salts, arsenic, selenium, other metals and volatile and aromatic organic contaminates into the aquifer. Some companies are enhancing groundwater contamination potential by performing massive subsurface rubilization efforts and or using high pressure induction processes which cannot be controlled and ultimately lead to groundwater contamination potential. Processing of oil shale and sands has over seventy years of serious application mostly ex situ—surface retorting, not many companies that develop these or similar resources have successfully deployed technologies to protect groundwater.

Shell, a major participant in oil shale development, attempts to solve the problem by erecting an "ice wall" around their production wells. The ice wall is a 30-feet-thick frozen barrier that extends from the surface to 1,700 feet below the ground and prevents both groundwater from seeping in and chemicals and contaminants from seeping out. The wall is pumped full of an ammonia-based coolant and takes about eighteen (18) months for the adjacent water and rock to freeze to −60° F. to create the massive ice wall. This method is very expensive to maintain and involves very large power inputs and doesn't address the potential post barrier contamination problems and has had failure problems which can result in no effective protection. Other companies are trying avoidance. For example, American Shale Oil is targeting specific layers of oil shale in order to avoid contact with groundwater. This approach limits the application of their technology to only a few locations.

SUMMARY OF THE INVENTION

This invention resides in a system and method for protecting an underground aquifer from pollution due to mining and other subsurface operations, including the in situ gasification of hydrocarbonaceous products from a recovery well. In accordance with a method aspect of the invention a plurality of barrier injection wells are formed around the recovery well, each barrier injection well terminating in a groundwater layer to be protected. The wells are preheated with steam, then a non toxic-degradable polymer matrix material is then pumped into the injection wells such that the material exiting each injection well expands and overlaps with material exiting from adjacent wells prior to cooling and subsequent solidification, thereby forming an isolation barrier within the groundwater layer.

In the preferred embodiment, the polymer matrix material is a thermally labile non-toxic cellulose polymer hydrogel matrix material which is injected in gel form. A region surrounding the recovery well is preheated to control the rate at which the material from each injection well expands and overlaps. The isolation barrier may be monitored continuously for integrity or stability and additional polymer hydrogel matrix material may be re-injected as necessary. Once the barrier wall is formed the remaining water inside the barrier region is pumped out. Residual water immediately surrounding an in situ oil shale recovery well may be heated to a temperature sufficient to vaporize residual water present in the environment for extraction from the recovery well. The barrier may be maintained indefinitely or removed once mining operations have completed. Following recovery of the hydrocarbonaceous products from the recovery well(s), the injected polymer matrix material may be re-heated and liquefied and the groundwater flow reestablished. Even though the above mentioned preferred embodiment for in situ oil shale recovery maintains most subsurface structural integrity and uses a negative pressure recovery process hydrocarbonaceous products to maximize product and contaminant recovery residual aromatic hydrocarbons, volatile organic hydrocarbons and heavy metals dislodged during mineral heating can still be present. This process allows for the use of the injection wells to also inject trace contaminant capture agents. Activated carbon slurry may be injected to capture remaining hydrocarbon contaminants. Zerovalent iron may also be introduced into one or more of the barrier injection wells to effectively remove metal contaminants through adsorption and co-precipitation.

A system for protecting groundwater during the recovery of hydrocarbonaceous products following in situ gasification comprises one or more recovery wells for extracting hydrocarbonaceous products from shale or sand following in situ gasification; a plurality of barrier injection wells around the recovery wells, each barrier injection well terminating in a groundwater layer to be protected; and apparatus for injecting a polymer hydrogel matrix material into the injection wells such that the material exiting each injection well expands and overlaps with material exiting from adjacent wells prior to solidification, thereby forming an isolation barrier within the groundwater layer.

DETAILED DESCRIPTION OF THE INVENTION

This invention is directed to an apparatus and method for protecting groundwater during the recovery of hydrocarbonaceous products from nonrubilized oil shale and oil/tar sands, including in situ oil shale gasification processes of the type disclosed and described in U.S. patent application Ser. No. 12/421,325, the entire content of which is incorporated herein by reference.

A plurality of steps is utilized in the preferred embodiment. First, as depicted in FIG. 1 at 102, a thermally degradable non-toxic polymer hydrogel matrix material is introduced into the aquifer layer 112 as a temporary barrier surrounding the processing site 110 to restrict or eliminate groundwater flow into the recovery well processing area. Only polymers that are either completely natural and non-toxic or man-made with historically demonstrated non-toxicity will be utilized in the process. In the preferred embodiments, as disclosed in further detail below, a cellulose-based polymer is used.

Figure 1A:
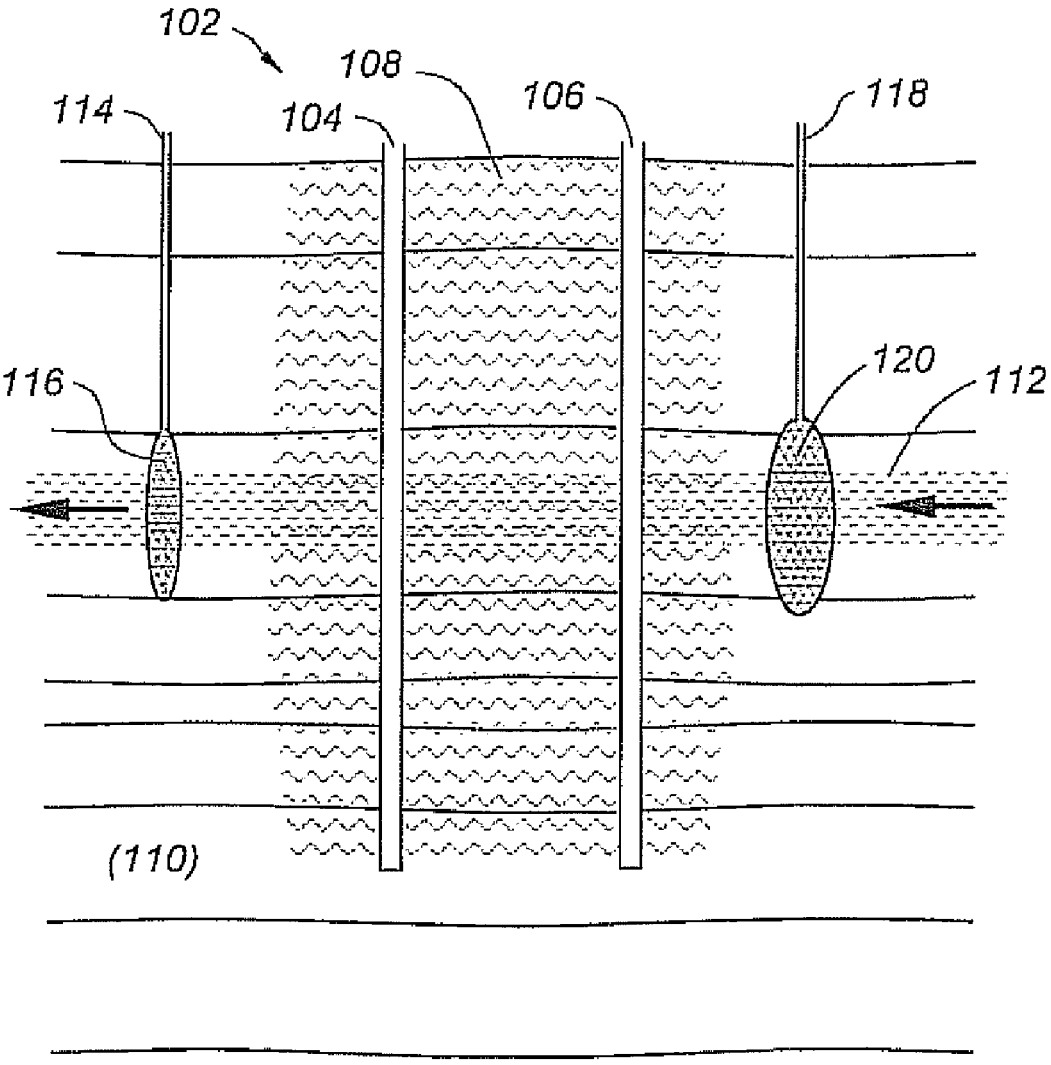
FIG. 1A is a cross-sectional view of a groundwater barrier formed in accordance with the invention.
Figure 1B:
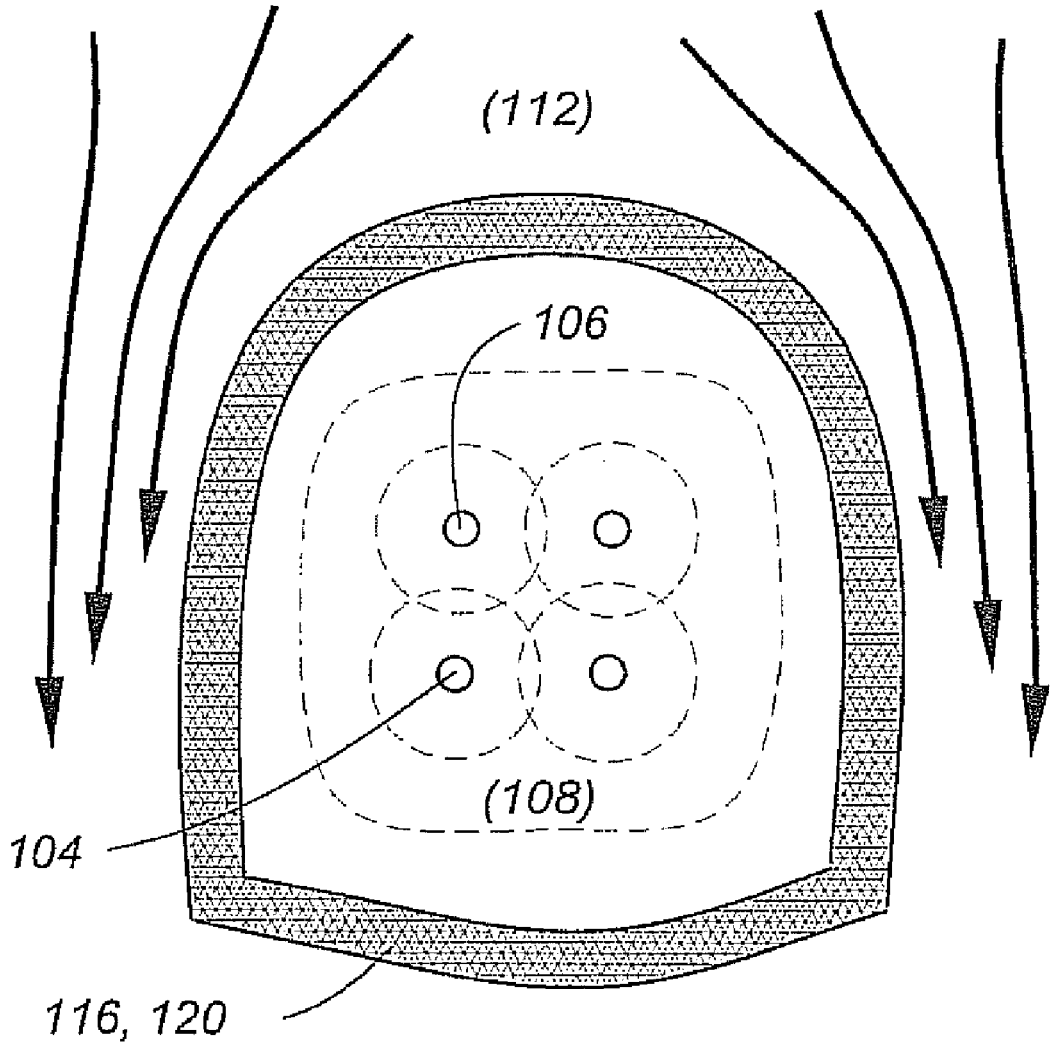
FIG. 1B is a top-down view of the barrier depicted in FIG. 1.
Figure 3:
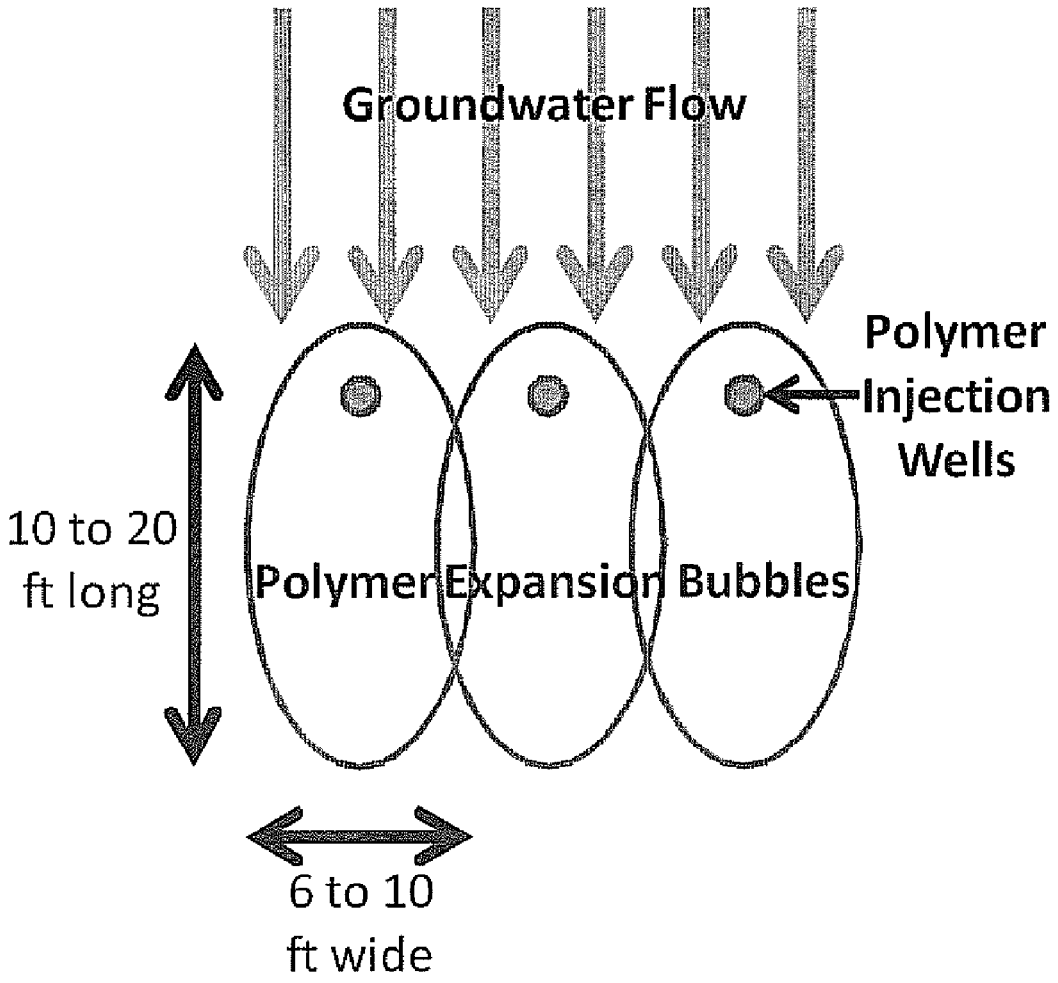
FIG. 3 depicts an overlap of polymer expansion bubbles.

In FIGS. 1A and 1B, the recovery wells are labeled 104, 106. Although only two such wells are shown the invention is not limited in this regard, and numerous wells may be surrounded as practical. The wells 104, 106 establish an in situ heated zone 108. Barrier injection wells such as 114, 118 are placed just outside or perhaps within the heated zone 108. Polymer hydrogel matrix material in then injected in to the wells, 114, 118 in gel form which expands to form overlapping expansion bubbles 116, 120 as shown in FIG. 3. These overlapping bubbles form a continuous wall seen in FIG. 1B. Depending upon the material used, temperature and other factors, each bubble may have a diameter in the range of 6 feet or less to 20 feet or more, and will probably assume a somewhat oblong shape due to water flow, as depicted in FIG. 3.

In many situations, utilizing the relative negative pressure system described in the Ser. No. 12/421,325 application, gases, including volatile organic and other contaminants, are drawn toward the effluent stream continuously and away from groundwater resources. At the process's elevated temperatures, residual water present in the environment in the "now dry" aquifer surrounding the processing well, will immediately vaporize to form a steam bubble and then be recovered. All such captured vaporized water will be cleaned in accordance with local, state and federal regulations. Also unique to the system and process described in the Ser. No. 12/421,325, Application, the core process generates a chemically reduced environment within the processing area by strict control of introduced and evolved oxygen. It is anticipated that under these reductive conditions, less physical damage to the subsurface rock formations will occur and less metal will become available for aquifer exposure.

During in situ kerogen cracking processes, arsenic, selenium and other heavy metals and aromatic and other volatile hydrocarbons may become groundwater available following anticipated efforts to perform carbon dioxide sequestration using existing technology primarily used for surface aquifer (Vadose zone) protection. To protect the groundwater from these metal contaminants, a slurry of zerovalent iron is introduced into the isolation barrier injection wells. This material acts as a permeable reactive barrier, affording removal of the metal contaminants by adsorption and co-precipitation with iron corrosion products, thereby protecting the groundwater. To protect the groundwater from these organic contaminants a slurry of activated carbon may be introduced into the injection wells. This material adsorbs organic compounds and effectively removes them from the flowing groundwater.

The combination of the barrier isolation, the negative pressure and reduced chemistry environment, minimizes mineral degradation reducing salt formation and further protects the groundwater. The opportunity to introduce a permeable reactive barrier (as required) will ensure effective during and post groundwater protection.

An example of a polymer matrix applicable to the invention is a temperature-defined and driven hydrogel dispersed with insoluble cellulose forming a colloidal suspension with viscoelastic properties. This gel is injected into a preheated aquifer zone as a liquid that expands to the required overlap field and subsequently solidifies upon cooling to form the impermeable isolation barrier.

The temperature dependencies of the polymer hydrogel matrices may be adjusted per system based on depth, aquifer type (packed bed, etc.) and the associated geothermal gradient. The isolation barrier will preferably be continuously monitored for integrity and stability, with new cellulose polymer hydrogel reinjected as required. After oil shale depletion and other barrier-related requirements, reheating the isolation barrier injection wells with steam to above the gelation temperature ($T_{gel}$) will take the solid hydrogel matrix back to a liquid and, over a short period of time and with dilution, will reopen the aquifer to full flow again. The hydrogel matrix can also be developed to have sensitivities to specific ions and/or pH level for the purposes of subsequent liquification.

Figure 2:
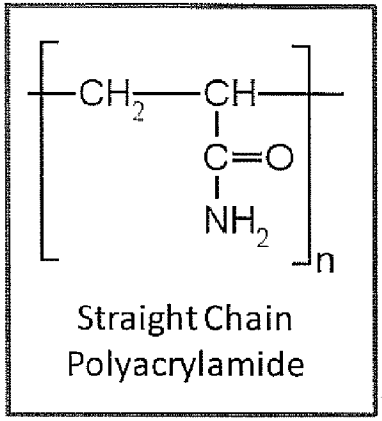
FIG. 2 illustrates representative polymers applicable to the invention.
Figure 2:
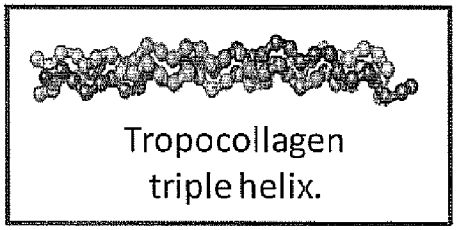
Figure 2:
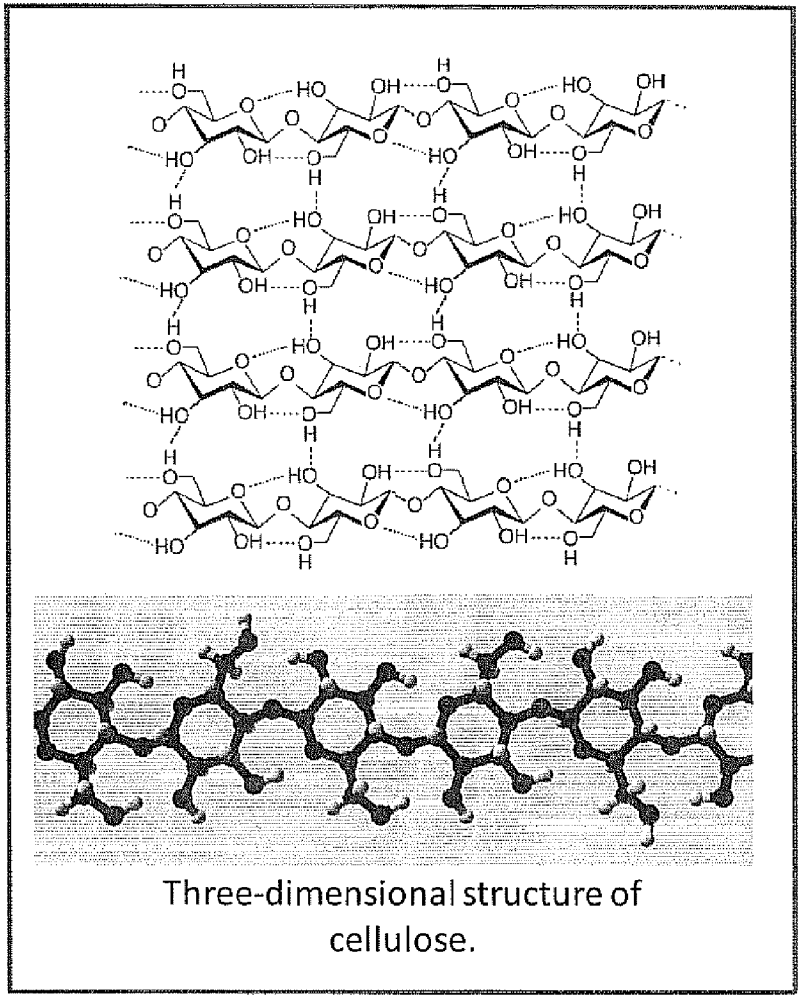

In developing suitable polymer matrices, trade-offs such as "effective clogging" versus "bubble expansion" may be addressed. As depicted in FIG. 2, candidates for the hydrogel and polymer matrices include cellulose, cellophane and rayon (regenerated cellulose fibers), microcrystalline cellulose, nitrocellulose (plastics), lignins and collagens. Non-natural polymers include high-molecular-weight polyacrylamides and silicone-based crosslinked hydrogels.

Since the primary focus is to clog the aquifer, the size of the insoluble polymers and the crosslinking of the hydrogel polymers are important considerations. The polymers need to clog—but not too fast—so that bubble expansion can occur. Effective bubble overlap, as shown in FIG. 3 ideally creates a leak-free barrier wall. This requires an aquifer medium tuned variable three-dimensional crosslinked networks, and the introduction of size-inclusion-based insoluble cellulose to solidify the isolation strategy.

The temperature dependencies of the hydrogel polymer matrices may also be adjusted per system based on depth, aquifer type (e.g., packed bed) and the associated geothermal gradients. Temperature control of the hydrogel polymers and the aquifer environment may be needed to guarantee required expansion and subsequent cooling and solidifying insuring an effective isolation barrier is put in place. After oil shale depletion and other barrier related requirements, reheating of the isolation barrier injection wells with steam to above the gelation temperature ($T_{gel}$) will take the solid hydrogel matrix back to a liquid and with dilution will reopen the aquifer to full flow again. The hydrogel matrix can also be developed to have ion and pH sensitivities.

I claim:

1. A method of protecting an underground aquifer from pollution during the extraction of subsurface products from at least one recovery well, the method comprising the steps of:

forming a plurality of barrier injection wells around the recovery well, each barrier injection well terminating in a groundwater layer to be protected; and injecting a polymer matrix material into the injection wells such that material exiting each injection well expands and overlaps with material exiting from adjacent wells prior to solidification, thereby forming an isolation barrier within the groundwater layer.

2. The method of claim 1, wherein the polymer matrix material is a cellulose polymer hydrogel matrix material.

3. The method of claim 1, wherein the polymer matrix material is injected in gel form.

4. The method of claim 1, further including the step of preheating a region surrounding the recovery well to control the rate at which the material from each injection well expands and overlaps.

5. The method of claim 1, further including the steps of:

monitoring the isolation barrier for integrity or stability; and injecting additional polymer matrix material as necessary to maintain a desired level of integrity or stability.

6. The method of claim 1, further including the steps of:

heating a region surrounding the recovery well to a temperature sufficient to vaporize residual water present in the environment; and extracting the liquid and vapor from the recovery well.

7. The method of claim 1, further including the step of introducing zerovalent iron or other contaminant capture agents into one or more of the barrier injection wells to remove metal and other contaminants through adsorption and co-precipitation.

8. The method of claim 1, further including the steps of:

re-liquefying the injected polymer matrix material; and extracting the re-liquefied material through one or more of the barrier injection wells.

9. The method of claim 1, further including the step of extracting gasified hydrocarbonaceous products from the recovery well.

10. A system for protecting groundwater during the extraction of subsurface products from at least one recovery well, comprising:

a plurality of barrier injection wells around the recovery wells, each barrier injection well terminating in a groundwater layer to be protected; and apparatus for injecting a polymer matrix material into the injection wells such that material exiting each injection well expands and overlaps with material exiting from adjacent wells prior to solidification, thereby forming an isolation barrier within the groundwater layer.

11. The system of claim 10, wherein the polymer matrix material is a cellulose polymer hydrogel matrix material.

12. The system of claim 10, wherein the polymer matrix material is injected in gel form.

13. The system of claim 10, further including a heater for heating a region surrounding the recovery well to control the rate at which the material from each injection well expands and overlaps.

14. The system of claim 10, further including:

a monitor for monitoring the isolation barrier for integrity or stability so that additional polymer matrix material may be injected as necessary to maintain a desired level of integrity or stability.

15. The system of claim 10, further including a heater for heating a region surrounding the recovery well to a temperature sufficient to vaporize residual water so that it may extracted from the recovery well.

16. The system of claim 10, further including one or more recovery wells for extracting hydrocarbonaceous products from shale or sand following in situ gasification.

* * * * *